US007721912B2

(12) United States Patent
Rader

(10) Patent No.: US 7,721,912 B2
(45) Date of Patent: May 25, 2010

(54) HINGE ASSEMBLY USING SUBSTANTIALLY STRAIGHT HINGE PIN

(75) Inventor: Henning Rader, Middleburg, VA (US)

(73) Assignee: Monoflo International, Inc., Winchester, VA (US)

( * ) Notice: Subject to any disclaimer, the term of this patent is extended or adjusted under 35 U.S.C. 154(b) by 1662 days.

(21) Appl. No.: 10/284,474

(22) Filed: Oct. 31, 2002

(65) Prior Publication Data

US 2004/0083578 A1 May 6, 2004

(51) Int. Cl.
*B65D 43/14* (2006.01)

(52) U.S. Cl. ..... 220/844; 220/4.22; 220/842; 16/379; 16/380

(58) Field of Classification Search ..... 220/4.22, 220/836, 842, 843, 844; 16/357, 361, 380, 16/379, 373, 386
See application file for complete search history.

(56) References Cited

U.S. PATENT DOCUMENTS

| | | | | |
|---|---|---|---|---|
| 753,381 | A | 3/1904 | Vom Eigen | |
| 2,012,800 | A | 8/1935 | Allen | |
| 2,762,076 | A | 9/1956 | Kiba | |
| 3,659,999 | A * | 5/1972 | Schurman | 425/525 |
| 3,828,969 | A | 8/1974 | Schurman | |
| 3,886,645 | A * | 6/1975 | Schurman | 29/434 |
| 4,558,799 | A * | 12/1985 | Hammond | 220/844 |
| 4,615,464 | A * | 10/1986 | Byrns | 220/844 |
| 4,663,803 | A | 5/1987 | Gora | |
| 4,685,567 | A * | 8/1987 | Webb | 220/811 |
| 5,320,239 | A * | 6/1994 | Favre | 220/844 |
| 5,474,200 | A | 12/1995 | Nicholson | |
| 6,000,576 | A | 12/1999 | Liu | |
| 6,021,784 | A * | 2/2000 | Yuhara | 220/844 |
| 6,315,154 | B1 | 11/2001 | Newby, Sr. | |

FOREIGN PATENT DOCUMENTS

| | | |
|---|---|---|
| JP | 6-146696 | 5/1994 |

* cited by examiner

*Primary Examiner*—Nathan J Newhouse
(74) *Attorney, Agent, or Firm*—Nixon & Vanderhye P.C.

(57) ABSTRACT

A hinge assembly incorporates a substantially straight hinge pin for securing a lid to a container. At least one end of a hinge line is initially closed via a plastic wall. The substantially straight hinge pin is secured in the hinge line via passing the hinge pin through the plastic wall. Subsequently, residual axial and radial stresses caused by passing the hinge pin through the wall cause the opening to contract, thereby retaining the pin. By providing a hinge assembly including a substantially straight hinge pin, the assembly process can be more easily automated.

2 Claims, 2 Drawing Sheets

HINGE ASSEMBLY USING SUBSTANTIALLY STRAIGHT HINGE PIN

CROSS-REFERENCES TO RELATED APPLICATIONS (NOT APPLICABLE)

STATEMENT REGARDING FEDERALLY SPONSORED RESEARCH OR DEVELOPMENT (NOT APPLICABLE)

BACKGROUND OF THE INVENTION

The present invention relates to a hinge construction generally for a container and lid assembly and, more particularly, to a hinge assembly for securing a container and lid assembly using a substantially straight hinge pin.

With reference to FIG. 1, the industry standard distribution container is an assembly including a tube-like box with two interlocking lids that attach using metal hinge pins. Like any hinge, the pins must be retained or with use they will begin to work out.

The most common and current way of retaining the pin once it has been installed is via a protrusion or hump that is interference fitted into a slot in the lid. When the pin is installed, the protrusion is captured in the slot and the pin is retained. An example of this conventional construction is shown in FIG. 2. Other methods have been tried but with little or no success. One known attempt used a bend on the end of the pin intended to displace the end from the entry hole after insertion.

Inherent disadvantages of these designs are apparent in any attempt to automate the assembly process. That is, the pin must be properly oriented in two dimensions. Additionally, the bump or bend must be oriented to enter the hinge last, and must be oriented vertically to engage the locking point. Automatic feeding mechanisms that can reliably achieve proper orientation are prohibitively complex and expensive.

BRIEF SUMMARY OF THE INVENTION

It would thus be desirable to enable a hinge pin assembly to utilize a substantially straight hinge pin, offering an advantage in automation because orientation is simplified. Retention, however, becomes an important consideration, and the present invention endeavors to utilize the physical properties of polyolefins and the like to positively retain a substantially straight hinge pin.

In an exemplary embodiment of the invention, a plastic lid is securable to a container using a substantially straight hinge pin. The plastic lid includes a hinge line shaped to receive the substantially straight hinge pin and secure the lid to the container. The hinge line is initially closed via a plastic wall at at least one end, and the hinge pin is held in the hinge line after passing the hinge pin through the plastic wall. The plastic wall and/or the plastic lid may be formed of a polyolefin material. In this context, the polyolefin material has elastomeric and creep properties such that a predetermined period of time after a 0.100 inch diameter pin is passed through the plastic wall, an entry hole therein is about 0.06 inch diameter.

In another exemplary embodiment of the invention, a hinge assembly is provided for securing a lid to a container. The hinge assembly includes a hinge line formed in one of the lid and the container, at least one end of the hinge line being initially closed via a plastic wall; and a substantially straight hinge pin secured in the hinge line via passing the hinge pin through the plastic wall.

In still another exemplary embodiment of the invention, a method of securing a substantially straight hinge pin in a hinge line of a container and lid assembly includes the steps of closing at least one end of the hinge line via a plastic wall; and passing the hinge pin through the plastic wall. After passing the hinge pin through the plastic wall, a hole created thereby contracts to secure the hinge pin. Preferably, the step of closing at least one end of the hinge line is practiced while molding the container and lid assembly.

BRIEF DESCRIPTION OF THE DRAWINGS

These and other aspects and advantages of the present invention will be described in detail with reference to the accompanying drawings, in which.

DETAILED DESCRIPTION OF PREFERRED EMBODIMENTS

Figure 1:
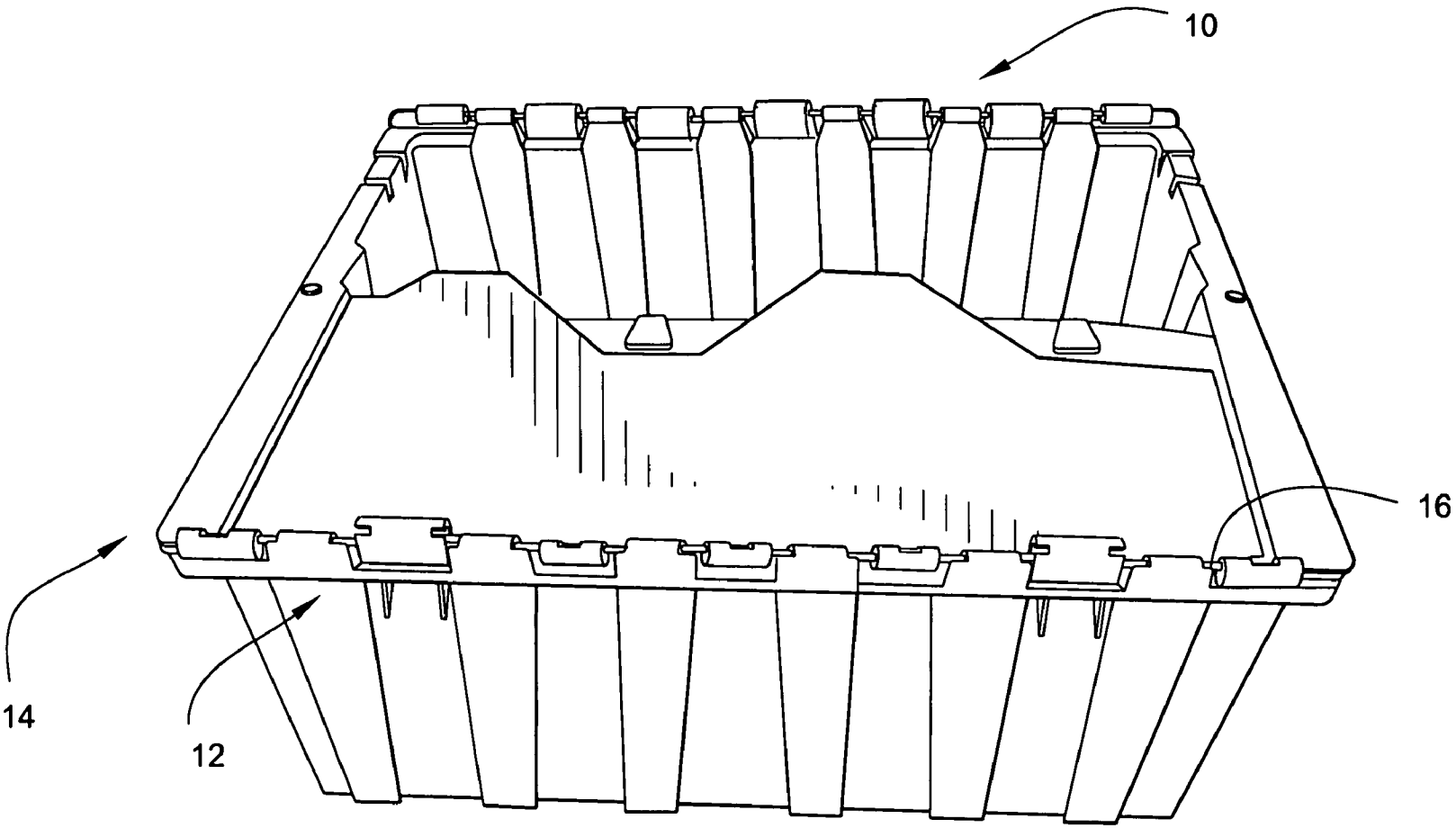
Fig. 1 (PRIOR ART)
FIG. 1 illustrates an industry standard distribution container.
Figure 2:
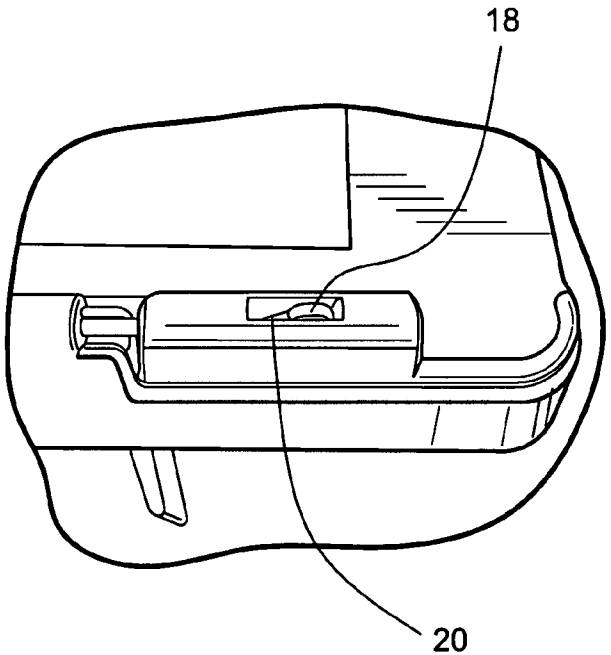
Fig. 2 (PRIOR ART)
FIG. 2 shows a conventional hinge pin with its protrusion fitted into a slot in the lid.

As shown in FIG. 1, the industry standard distribution container 10 generally secures its lid or lids (not shown) via a hinge assembly 12 including a hinge line 14 defined by aligned openings of the container and lid(s) and a hinge pin 16. As noted above, ends of the hinge pin 16 are generally provided with a protrusion or hump 18 (FIG. 2) that is interference fitted into a slot 20 in the lid.

Figure 3C:
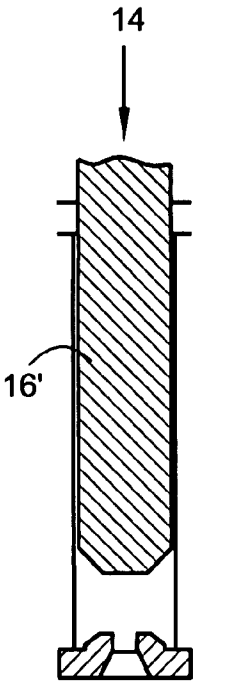
FIGS. 3A-3C illustrate the hinge pin assembly and securing construction according to the present invention.
Figure 3B:
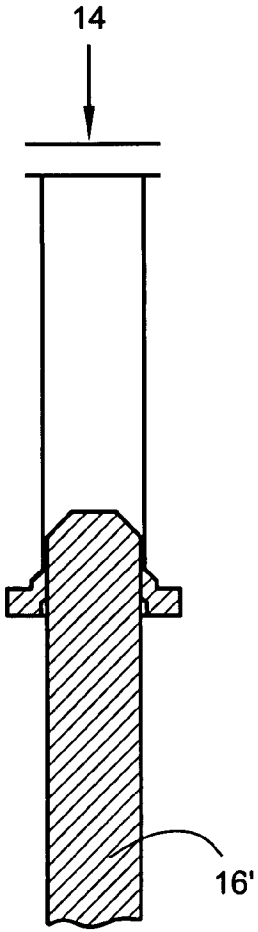
Figure 3A:
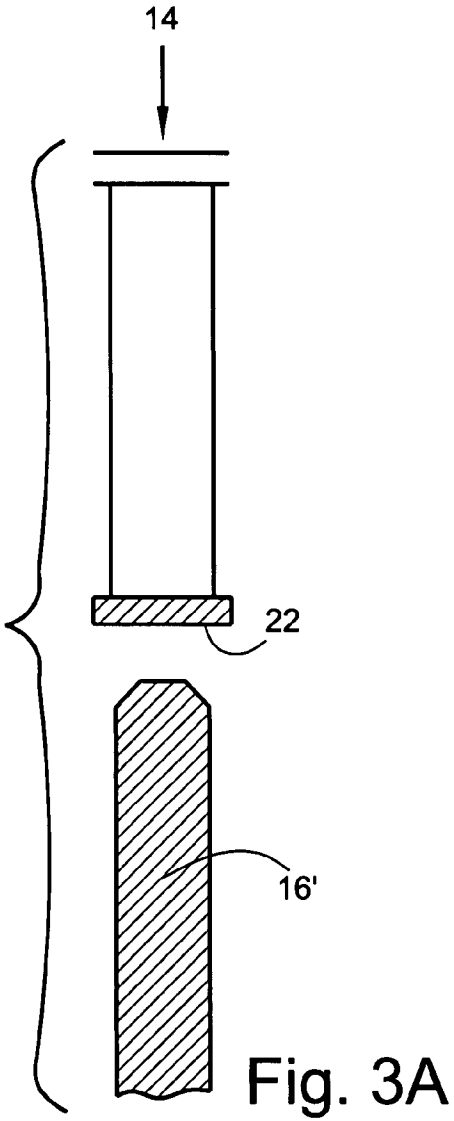

FIGS. 3A-3C show a hinge assembly according to the present invention. The hinge line 14 is generally shown schematically in FIGS. 3A-3C having at least one end initially closed via a plastic wall 22. With reference to FIGS. 3B and 3C, the container is assembled and the lid is secured by forcing a substantially straight hinge pin 16' according to the present invention through the plastic wall 22.

In operation, very little or no plastic is removed via the insertion of the hinge pin 16', but is forced aside leaving residual axial and radial stresses. As soon as the hinge pin 16' clears the wall (FIG. 3C), the hole contracts, and the pin 16' is retained.

Preferably, the material of the plastic wall is a polyolefin material having particular elastomeric and creep properties. For example, the elastomeric and creep properties of the polyolefin material according to the present invention may be configured such that a predetermined time (e.g., three days) after a 0.100 inch diameter pin has been inserted through the closed wall 22, the entry hole is approximately 0.060 inches in diameter. Careful selection of hinge pin 16' diameter, wall thickness and pin end configuration allow the substantially straight pin 16' to be securely retained.

Pin diameters of 0.100 inch are preferred because this is the nominal diameter for the application. Significantly smaller pin diameters may require modification of lid and container hinge dimensions, would reduce ruggedness of the lid to container attachment, would reduce weight-bearing capability of the assembly, and may buckle when penetrating the barrier. Significantly larger pin diameters will require modification of the lid and container since the opening retaining the pin is typically 0.150 inch or less. Larger pins also have the disadvantage of using more material and hence being more expensive without providing any advantage to the assembly.

Wall thicknesses of 0.025-0.035 inch were found to be optimum with the components tested. This thickness is specific to a particular polymer (i.e., HDPE) and specification. Harder polymers might require a thinner wall for optimum penetration while softer polymers might tolerate thicker walls. Walls that are too thin may tear upon penetration and fail to capture the pin while thicker walls require larger components to provide penetrating force.

Modest bevels at both ends of the pin are standard specifications for this type of component. The bevel is relatively simple to apply in manufacturing and removes jagged edges that may have been left when the pin was cut. This provides an acceptable penetrator without modification, and the end opposite the penetration retains a flat end to which accommodates the end of a ram for inserting the pin in the automated process. If the pin were sharpened, the penetration would require less force, however the expense of sharpening is generally not worth the force reduction. Pins that are cut and have no secondary operation tend to have ends that are larger than the pin diameter, which increases the penetrating force and enlarges the hole left in the wall.

With the hinge assembly according to the present invention, a substantially straight hinge pin can be securely retained. As a consequence, economically advantageous automation of a typically labor-intensive assembly process is facilitated.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A plastic lid securable to a container using a substantially straight hinge pin, the plastic lid comprising a portion of a hinge line shaped to receive the substantially straight hinge pin and secure the lid to the container, wherein the hinge line portion is initially closed via a plastic wall at least one end, wherein the hinge pin is held in the hinge line portion via contraction of an entry hole formed by passing the hinge pin through the plastic wall, and wherein the plastic wall is formed of a polyolefin material that has elastomeric and creep properties such that a predetermined period of time after a 0.100 inch diameter pin is passed through the plastic wall, the entry hole therein is about 0.06 inch diameter.

2. A hinge assembly for securing a lid to a container, the hinge assembly comprising:

a portion of a hinge line formed in one of the lid and the container, at least one end of the hinge line portion being initially closed via a plastic wall; and a substantially straight hinge pin secured in the hinge line portion via contraction of an entry hole formed by passing the hinge pin through the plastic wall, wherein the plastic wall is formed of a polyolefin material that has elastomeric and creep properties such that a predetermined period of time after a 0.100 inch diameter pin is passed through the plastic wall, the entry hole therein is about 0.06 inch diameter.

* * * * *